US005806997A

United States Patent [19]

Kawanabe

[11] Patent Number: 5,806,997

[45] Date of Patent: Sep. 15, 1998

[54] DOT MATRIX PRINTER

[75] Inventor: Tetsuya Kawanabe, Irvine, Calif.

[73] Assignee: Canon Business Machines, Inc., Costa Mesa, Calif.

[21] Appl. No.: 603,711

[22] Filed: Feb. 20, 1996

[51] Int. Cl.[6] ..... B41J 2/30

[52] U.S. Cl. ..... 400/124.01; 395/115

[58] Field of Search ..... 400/124.01, 124.04; 395/114, 115, 116; 347/180

[56] References Cited

U.S. PATENT DOCUMENTS

| | | | |
|---|---|---|---|
| 4,476,542 | 10/1984 | Crean et al. | 364/900 |
| 4,520,455 | 5/1985 | Crean et al. | 364/900 |
| 4,663,729 | 5/1987 | Matick et al. | 364/900 |
| 4,674,895 | 6/1987 | Tanaka | 400/303 |
| 4,747,070 | 5/1988 | Trottier et al. | 364/900 |
| 4,942,541 | 7/1990 | Hoel et al. | 364/519 |
| 4,977,519 | 12/1990 | Chang et al. | 364/519 |
| 4,984,182 | 1/1991 | Chang et al. | 364/519 |
| 5,108,207 | 4/1992 | Isobe et al. | 400/70 |
| 5,206,932 | 4/1993 | Chang et al. | 395/165 |
| 5,210,822 | 5/1993 | Tsuchiya et al. | 395/115 |
| 5,581,295 | 12/1996 | Prowak | 347/237 |

*Primary Examiner*—Edgar S. Burr
*Assistant Examiner*—Steven S. Kelley
*Attorney, Agent, or Firm*—Fitzpatrick, Cella, Harper & Scinto

[57] ABSTRACT

A dot matrix printing apparatus which designates an area of a memory as a print buffer and which outputs print data from the print buffer to a printer head having print elements for printing the print data. The dot matrix printing apparatus includes a memory, an area of which is designatable as a print buffer, and a processor which (1) executes an application program to generate the print data, (2) determines size data for the print data, the size data comprising a number of columns of print data and an amount of print data per each column, the amount of print data per each column being derived from a number of operable print elements on the printer head, (3) designates an area of the memory as a print buffer based on the size data, the print buffer being defined by address data, and (4) stores the print data in the print buffer. Also included in the dot matrix printing apparatus is a controller which receives the size data and the address data from the processor, and which uses the size data and the address data to output columns of print data, one column at a time, from the print buffer to the operable print elements on the printer head.

9 Claims, 9 Drawing Sheets

| ADDRESS | +0 | +1 | +2 | +3 | +4 | +5 | +6 | +7 | +8 | +9 | +10 | +11 | +12 | +13 | +14 | +15 |
|---|---|---|---|---|---|---|---|---|---|---|---|---|---|---|---|---|
| 0 | AA | AB | AC | AD | AE | AF | AG | AH | AI | AJ | AK | AL | AM | AN | AO | AP |
| 16 | BA | BB | BC | BD | BE | BF | BG | BH | BI | BJ | BK | BL | BM | BN | BO | BP |
| 32 | CA | CB | CC | CD | CE | CF | CG | CH | CI | CJ | CK | CL | CM | CN | CO | CP |
| ... | ... | ... | ... | ... | ... | ... | ... | ... | ... | ... | ... | ... | ... | ... | ... | ... |
| N*16 | ZA | ZB | ZC | ZD | ZE | ZF | ZG | ZH | ZI | ZJ | ZK | ZL | ZM | ZN | ZO | ZP |

FIG. 1

| | COLUMN 0 | COLUMN 1 | COLUMN 2 | ... | ... | COLUMN N-1 | COLUMN N |
|---|---|---|---|---|---|---|---|
| 1ST DOT ⋮ 8TH DOT | AA | BA | CA | ... | ... | ... | ZA |
| 9TH DOT ⋮ 16TH DOT | AB | BB | CB | ... | ... | ... | ZB |
| 17TH DOT ⋮ 24TH DOT | AC | BC | CC | ... | ... | ... | ZC |
| 25TH DOT ⋮ 32ND DOT | AD | BD | CD | ... | ... | ... | ZD |
| 33RD DOT ⋮ 40TH DOT | AE | BE | CE | ... | ... | ... | ZE |
| 41ST DOT ⋮ 48TH DOT | AF | BF | CF | ... | ... | ... | ZF |
| 49TH DOT ⋮ 56TH DOT | AG | BG | CG | ... | ... | ... | ZG |
| 57TH DOT ⋮ 64TH DOT | AH | BH | CH | ... | ... | ... | ZH |
| 65TH DOT ⋮ 72ND DOT | AI | BI | CI | ... | ... | ... | ZI |
| 73RD DOT ⋮ 80TH DOT | AJ | BJ | CJ | ... | ... | ... | ZJ |
| 81ST DOT ⋮ 88TH DOT | AK | BK | CK | ... | ... | ... | ZK |
| 89TH DOT ⋮ 96TH DOT | AL | BL | CL | ... | ... | ... | ZL |
| 97TH DOT ⋮ 104TH DOT | AM | BM | CM | ... | ... | ... | ZM |
| 105TH DOT ⋮ 112TH DOT | AN | BN | CN | ... | ... | ... | ZN |
| 113TH DOT ⋮ 120TH DOT | AO | BO | CO | ... | ... | ... | ZO |
| 121ST DOT ⋮ 128TH DOT | AP | BP | CP | ... | ... | ... | ZP |

FIG. 9

DOT MATRIX PRINTER

BACKGROUND OF THE INVENTION

1. Field of the Invention

The present invention relates to a dot matrix printer which designates an area of a RAM as a print buffer for storing print data, stores print data in the print buffer, and reads out the print data from the print buffer based on the same information used to designate the print buffer.

2. Description of the Related Art

As is generally known, a dot matrix printer prints a plurality of dots which, when viewed together, form an overall image. Typically, each dot is formed from one of a plurality of print elements on a printer head. Examples of these print elements are ink jets, in the case of an ink jet printer, and thermal elements, in the case of a thermal transfer-type printer.

Each print element is controlled by one bit of print data. A print buffer, such as that shown in FIG. 1, stores the print data in row/column format.

Some dot matrix printers have the ability to vary the size of their print buffers. In such dot matrix printers, this ability reduces the amount of memory wasted on the print buffer. However, due to the varying sizes of their print buffers, such dot matrix printers do not merely read out print data from the print buffer to the print elements. Rather, such dot matrix printers must correlate the print data read from the print buffer to appropriate print elements.

More specifically, in conventional dot matrix printers, the size and configuration of the print buffer corresponds to the number and configuration of print elements on the printer head, thus making it easy to read out print data from the print buffer to appropriate print elements. When the size of the print buffer varies, however, without a corresponding variation in the number and configuration of print elements, rows and columns of print data cannot simply be read from the print buffer and directly output to appropriate print elements. Rather, as noted above, read-out print data must be correlated to appropriate print elements. This correlation adds an additional layer of complexity to, and reduces the efficiency of, such conventional dot matrix printers.

Thus, there exists a need for a dot matrix printer which has a print buffer that is variable in size, which reads out print data from the print buffer to operable print elements on a printer head, and which reduces an amount of processing required to correlate the read-out print data to appropriate print elements on the printer head.

SUMMARY OF THE INVENTION

The present invention addresses the foregoing need by providing a dot matrix printing apparatus which designates an area of a memory as a print buffer for storing print data based on size data for the print data, the size data being derived both from the amount of print data to be stored and from a number of print elements on the printer head. A controller uses the size data, along with address data for the print buffer, to output columns of print data, one column at a time, from the print buffer to operable print elements on the printer head.

By using size data which relates both to an amount of print data to be stored and to a number of print elements on a printer head in order both to designate the size of the print buffer and to read out columns of print data from the print buffer, the present invention is able to accommodate variations in the size of the print buffer with respect to the number and configuration of print elements on the printer head. As a result, the present invention is able to reduce the amount of processing required to correlate read-out print data to appropriate print elements on the printer head.

Thus, according to one aspect, the present invention is a dot matrix printing apparatus which designates an area of a memory as a print buffer, and which outputs print data from the print buffer to a printer head having print elements for printing the print data. The dot matrix printing apparatus includes a memory, an area of which is designatable as a print buffer, and a processor which (1) executes an application program to generate the print data, (2) determines size data for the print data, the size data comprising a number of columns of print data and an amount of print data per each column, the amount of print data per each column being derived from a number of operable print elements on the printer head, (3) designates an area of the memory as a print buffer based on the size data, the print buffer being defined by address data, and (4) stores the print data in the print buffer. Also included in the dot matrix printing apparatus is a controller which receives the size data and the address data from the processor, and which uses the size data and the address data to output columns of print data, one column at a time, from the print buffer to the operable print elements on the printer head.

As noted above, by virtue of the foregoing configuration, it is possible to reduce the amount of processing required to correlate the read-out print data to the print elements on the printer head.

According to another aspect, the present invention is a dot matrix printing apparatus which designates an area of a RAM as a print buffer for storing print data comprised of M blocks by N columns, and which reads out the print data from the print buffer in order to print dot images. The dot matrix printing apparatus includes a RAM, an area of which is designatable as a print buffer, and a processor. The processor (1) executes an application program to generate the print data, (2) determines parameters which define a total number of columns of print data, a starting block of print data in each column of print data, and an ending block of print data in each column of print data, (3) determines a number of blocks of print data in each column of print data based on the starting block of print data in each column of print data and the ending block of print data in each column of print data, (4) allocates an area of the RAM as a print buffer based on the total number of columns of print data and the number of blocks of print data in each column of print data, the print buffer being defined by a starting address and an ending address, and (5) stores the print data in the print buffer. A controller (1) receives, from the processor, the starting address of the print buffer, the ending address of the print buffer, the total number of columns of print data, and the number of blocks of print data in each column of print data, (2) reads columns of print data, one at a time, from the print buffer, beginning at the starting address and ending at the ending address, using the total number of columns of print data and the number of blocks of print data in each column of print data, and (3) outputs the columns of print data, one at a time. A printer head having a plurality of print elements for printing dot images receives the columns of print data from the controller, and prints the dot images based on the columns of print data output by the controller.

By reading out the print data from the print buffer using the same information used to create the print buffer, i.e., the total number of columns of print data and the number of blocks of print data in each column of print data, the present invention is able to reduce the amount of processing required to correlate the read-out print data to appropriate print elements on the printer head. Thus, the present invention not only reduces the amount of memory wasted on the print buffer, but also reduces the amount of processing required to print out the print data from the print buffer.

According to still another aspect, the present invention is a method of controlling dot matrix printing in a dot matrix printer by designating an area of a RAM as a print buffer for storing print data comprised of M blocks by N columns, and by reading out the print data from the print buffer in order to print dot images. The method includes the steps of executing an application program to generate the print data, generating parameters which define a total number of columns of print data, a starting block of print data in each column of print data, and an ending block of print data in each column of print data, and determining a number of blocks of print data in each column of print data based on the starting block of print data in each column of print data and the ending block of print data in each column of print data. Also included in the method are steps of allocating an area of a RAM as a print buffer based on the total number of columns of print data and the number of blocks of print data in each column of print data, the print buffer being defined by a starting address and an ending address, storing the print data in the print buffer, and reading columns of print data from the print buffer, one at a time, beginning at the starting address of the print buffer and ending at the ending address of the print buffer, using the total number of columns of print data and the number of blocks of print data in each column of print data. The columns of print data are output, one at a time, to a printer head which has a plurality of print elements for printing dot images, and the dot images are printed, using the printer head, based on the columns of print data output in the outputting step.

By designating a print buffer based on a total number of columns of print data and a number of blocks of print data in each column of print data, and by reading out columns of print data from the print buffer using that same information, the foregoing aspect of the present invention is able to reduce the amount of processing required to correlate output print data to appropriate print elements on the printer head.

According to still another aspect, the present invention is a word processor having an installed dot matrix printer which designates an area of a RAM as a print buffer, the print buffer storing print data comprised of M blocks by N columns. The word processor reads out the print data from the print buffer in order to print dot images. The word processor includes a keyboard which inputs text and image data, a floppy disk drive, into which floppy disks are inserted which store additional text and image data, the additional text and image data being accessed and input via the keyboard, and a liquid crystal display which displays images based on one of the text and image data and the additional text and image data. Also included in the word processor are a ROM which stores a printer driver program and an application program, a RAM which stores the text and image data and the text and additional image data, an area of the RAM being designatable as a print buffer, and a printer head having a plurality of ink jets disposed thereon, which prints dot images based on received print data. A processor (1) executes the application program to generate print data based on the text and image data and the additional text and image data, (2) executes the printer driver program to generate parameters which define a total number of columns of print data, a starting block of print data in each column of print data, and an ending block of print data in each column of print data, (3) determines a number of blocks of print data in each column of print data based on the starting block of print data in each column of print data and the ending block of print data in each column of print data, the number of blocks of print data in each column of print data being proportional to a number of the plurality of ink jets disposed on the printer head, (4) allocates an area of the RAM as a print buffer based on the total number of columns of print data and the number of blocks of print data in each column of print data, the print buffer being defined by a starting address and an ending address, and (5) stores the print data in the print buffer. A printer controller (1) receives, from the processor, the starting address of the print buffer, the ending address of the print buffer, the total number of columns of print data, and the number of blocks of print data in each column of print data, (2) reads successive columns of print data, one at a time, from the print buffer beginning at the starting address of the print buffer and ending at the ending address of the print buffer using the total number of columns of print data and the number of blocks of print data in each column of print data, and (3) outputs the successive columns of print data, one at a time, to appropriate ink jets on the printer head.

Advantageously, the foregoing word processor reduces both the amount of memory wasted on a print buffer, and the amount of processing required to correlate print data read from the print buffer to appropriate ink jets on the printer head. As a result, the cost of the word processor is reduced, and its efficiency is increased.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

FIG. 1 shows an example of a print buffer broken down into N*16 columns, each column including 16 blocks of print data.

FIG. 9 shows columns of print data from the print buffer depicted in FIG. 1 being output via a printer head in accordance with the present invention.

DETAILED DESCRIPTION OF THE PREFERRED EMBODIMENT

The present invention is a dot matrix printing apparatus which designates an area of a memory as a print buffer and which outputs print data from the print buffer to a printer head having print elements for printing the print data. The dot matrix printing apparatus includes a memory, an area of which is designatable as a print buffer, and a processor which (1) executes an application program to generate the print data, (2) determines size data for the print data, the size data comprising a number of columns of print data and an amount of print data per each column, the amount of print data per each column being derived from a number of operable print elements on the printer head, (3) designates an area of the memory as a print buffer based on the size data, the print buffer being defined by address data, and (4) stores the print data in the print buffer. Also included in the dot matrix printing apparatus is a controller which receives the size data and the address data from the processor, and which uses the size data and the address data to output columns of print data, one column at a time, from the print buffer to the operable print elements on the printer head.

Figure 2:
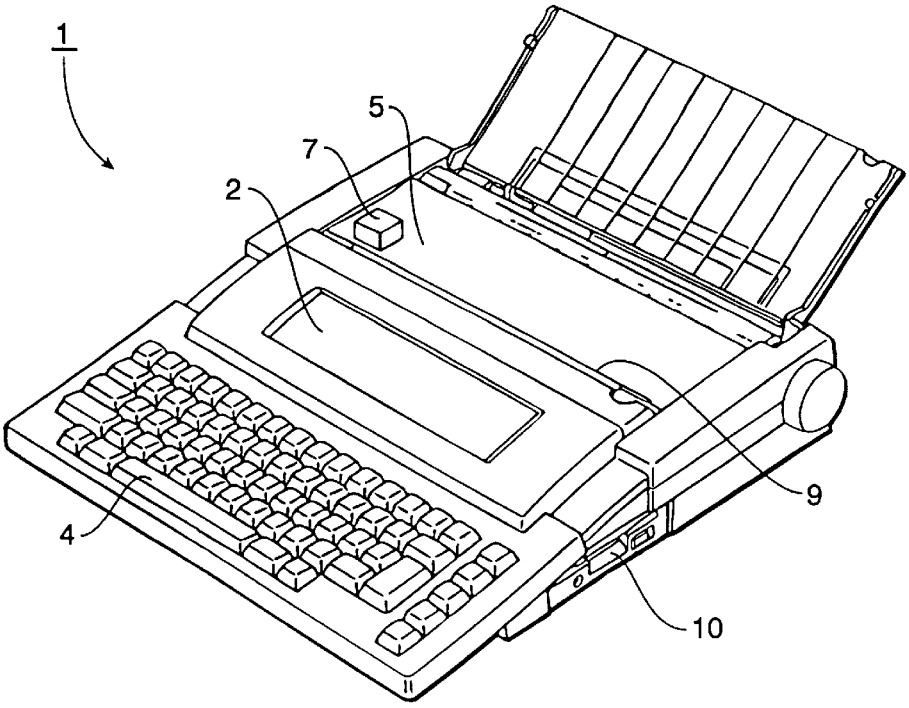
FIG. 2 shows a word processor having a dot matrix printer according to the present invention.

FIG. 2 is a view showing the outward appearance of a representative embodiment of the present invention. Shown in FIG. 2 is word processor 1, which includes display screen 2 for displaying images, keyboard 4 for entering text and programmer commands, and printer 5. Printer 5 includes printer head 7 for outputting print data generated by word processor 1, and guide 9, along which printer head 7 moves in a printing direction.

Printer 5 is a dot matrix printer. As noted above, printers of this type include a plurality of print elements such as ink jets, in the case of a dot matrix printer, and thermal elements, in the case of a thermal transfer-type printer. Each of these print elements forms an individual dot. Combined, these dots form an overall image.

At this point, it should be noted that although the present embodiment will be described with respect to an ink-jet-type printer, the present invention can also comprise a needle-pin-type printer, a thermal transfer-type printer, or any other type of dot matrix printer.

Figure 3:
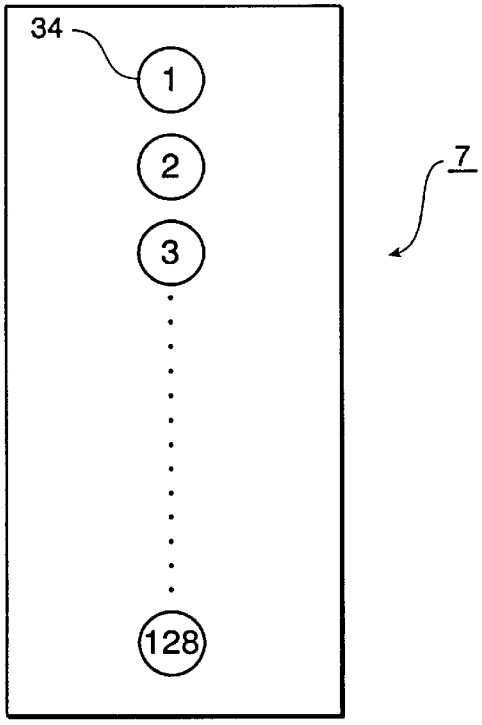
FIG. 3 shows a close-up view of a printer head having 128 ink jets arranged in a single vertical column.

Printer head 7, shown in FIG. 3, houses a plurality of print elements which, in the case of this embodiment, are ink jets. In preferred embodiments of the present invention, printer head 7 includes one vertical row of 128 ink jets, labelled 1 to 128 in FIG. 3. However, it is noted that the present invention can be used with a printer head having any configuration or number of ink jets. For example, the present invention can be used with a printer head having 24, 48, 64, 136, etc. ink jets. In addition, the present invention can be used with printer heads having several rows of ink jets, such as two rows of 24 ink jets, three rows of 24 ink jets, etc.

In preferred embodiments of the present invention, display screen 2 is a liquid crystal display (hereinafter "LCD"). It should be noted, however, that other types of displays can be used in conjunction with the present invention. For example, a light-emitting diode, or LED, display could be used instead of an LCD.

Word processor 1 also includes floppy disk drive interface 10, into which floppy disks are inserted. Information from such floppy disks can be accessed and edited using word processor 1, and information entered on word processor 1 can be stored on such floppy disks. This information can comprise image data, including character and text data, as well as pictorial and object image data. In addition, application programs can be stored in floppy disks and accessed by word processor 1 via floppy disk drive interface 10.

It should be understood that, although a word processor is shown in FIG. 2, a general purpose computing system, a dedicated or stand-alone computer, or any other type of data processing equipment can be used in the practice of the present invention.

Figure 4:
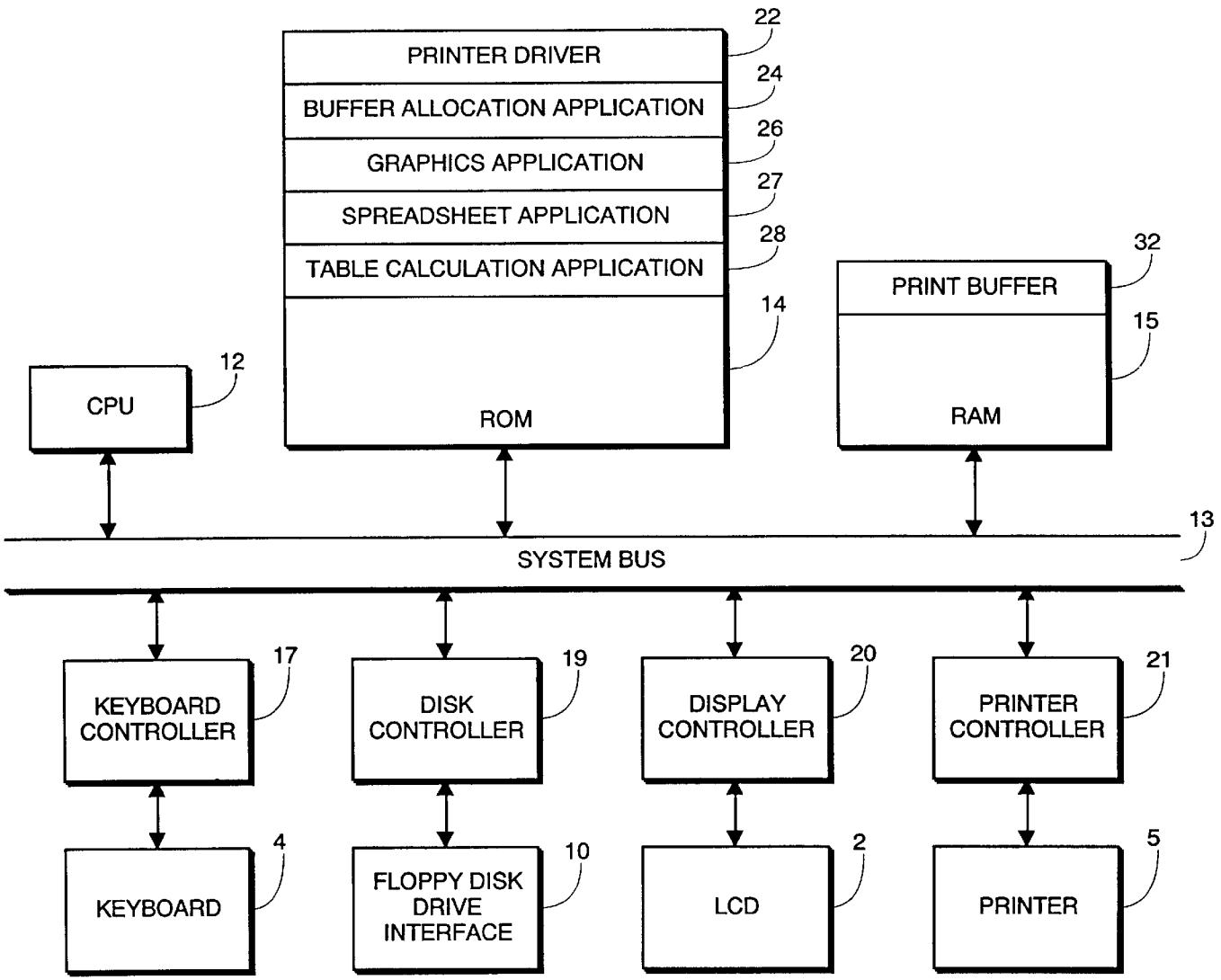
FIG. 4 shows components of the word processor shown in FIG. 2.

FIG. 4 is a detailed block diagram showing the internal construction of word processor 1. As shown in FIG. 4, word processor 1 includes central processing unit (hereinafter "CPU") 12 interfaced with system bus 13. Also interfaced with system bus 13 are ROM 14, RAM 15, keyboard controller 17, disk controller 19, display controller 20 and printer controller 21.

CPU 12 controls the interaction between the various components that comprise word processor 1. CPU 12 can comprise any type of commercially available microprocessor, such as an Intel 8086 series microprocessor. Specific functions of CPU 12 are described in greater detail below.

ROM 14 provides read-only memory storage for storing printer driver program 22. Printer driver program 22 formats print data generated by an application program so that the print data can be printed by printer 5. The functions of printer driver program 22 are described in more detail below.

ROM 14 also stores buffer allocation application program 24. Buffer allocation application program 24 is used by CPU 12 to allocate an area of RAM 15 as a print buffer for printer 5. The function of buffer allocation application program 24 is described in more detail below.

Other applications may also be stored in ROM 14, such as graphics application program 26, spreadsheet application program 27, and table calculation application program 28. The number and types of application programs that can be stored in ROM 14 vary with the capabilities of word processor 1, and with the storage capacity of ROM 14.

The foregoing examples of application programs are merely meant to show the types of application programs that can be stored in ROM 14, and are not intended to limit the application programs which can operate with the present invention.

RAM 15 provides random-access memory storage for use by CPU 12 when executing stored applications, such as buffer allocation application program 24 and spreadsheet application program 27. More specifically, CPU 12 loads such applications from ROM 14, or alternatively from a floppy disk in floppy disk drive interface 10, into RAM 15, and executes those stored programs out of RAM 15.

It is noted that RAM 15, rather than ROM 14, can also be used to store buffer allocation application program 24. For example, buffer allocation application program 24 could be loaded into RAM 15 from a floppy disk in floppy disk interface 10, or downloaded from an EEPROM (not shown) when word processor 1 is initialized.

As noted above, in the present invention, RAM 15 also provides a storage area for print buffer 32. Print buffer 32 stores print data in row-column format, e.g., M rows by N columns. An example of a print buffer which could be stored in RAM 15 is shown in FIG. 1. The size and location of print buffer 32 in RAM 15 are determined by buffer allocation application program 24 in accordance with parameters supplied by printer driver program 22 and print data supplied by a currently-executing application program, such as spreadsheet application program 27. This process is described in more detail below.

Keyboard controller 17 detects information input from keyboard 4, and transmits that information to CPU 12. More specifically, when a key on keyboard 4 is depressed, a code which is specific to the depressed key is transmitted to keyboard controller 17. Keyboard controller 17 receives and deciphers the transmitted code. Based on this information, keyboard controller 17 reports to CPU 12 which key on keyboard 4 has been depressed. CPU 12 then generates image data, such as character data, which corresponds to the depressed key, or alternatively, executes a function which corresponds to the depressed key.

Disk controller 19 controls input from and output to a floppy disk in floppy disk drive interface 10. More specifically, disk controller 19 interprets messages from CPU 12, and based on those messages, determines what action to take with respect to a floppy disk in floppy disk drive interface 10. For example, if data from RAM 15 is to be written to a floppy disk in floppy disk drive interface 10, CPU 12 directs disk controller 19 to access the data, and to write the data to the floppy disk. Similarly, if data is to be read from a floppy disk in floppy disk drive interface 10 and written to RAM 15, CPU 12 directs disk controller 19 to access the data, and to write the data to RAM 15.

Display controller 20 controls display screen 2. More specifically, when, for example, character data is to be displayed, CPU 12 instructs display controller 19 to access the character data and to display characters based on the character data. Data to be displayed may be stored in a floppy disk, in ROM 14, or in RAM 15 (such as data input via keyboard 4).

Printer controller 21 accesses print data in print buffer 32, and provides that print data to printer 5. More specifically, printer controller 21 receives instructions from CPU 12 to print data stored in print buffer 32. Upon receiving these instructions from CPU 12, printer controller 21 reads print data from print buffer 32 in RAM 15 and outputs the print data to printer 5, specifically to printer head 7.

The foregoing brief description is provided merely as an overview of printer controller 21's functionality. Detailed descriptions of printer controller 21's functionality and physical configuration are provided below.

As noted above, the present invention designates an area of RAM 15 for use as a print buffer for printer 5. This process, which is performed by buffer allocation application program 24, is described below with respect to FIG. 5.

Figure 5:
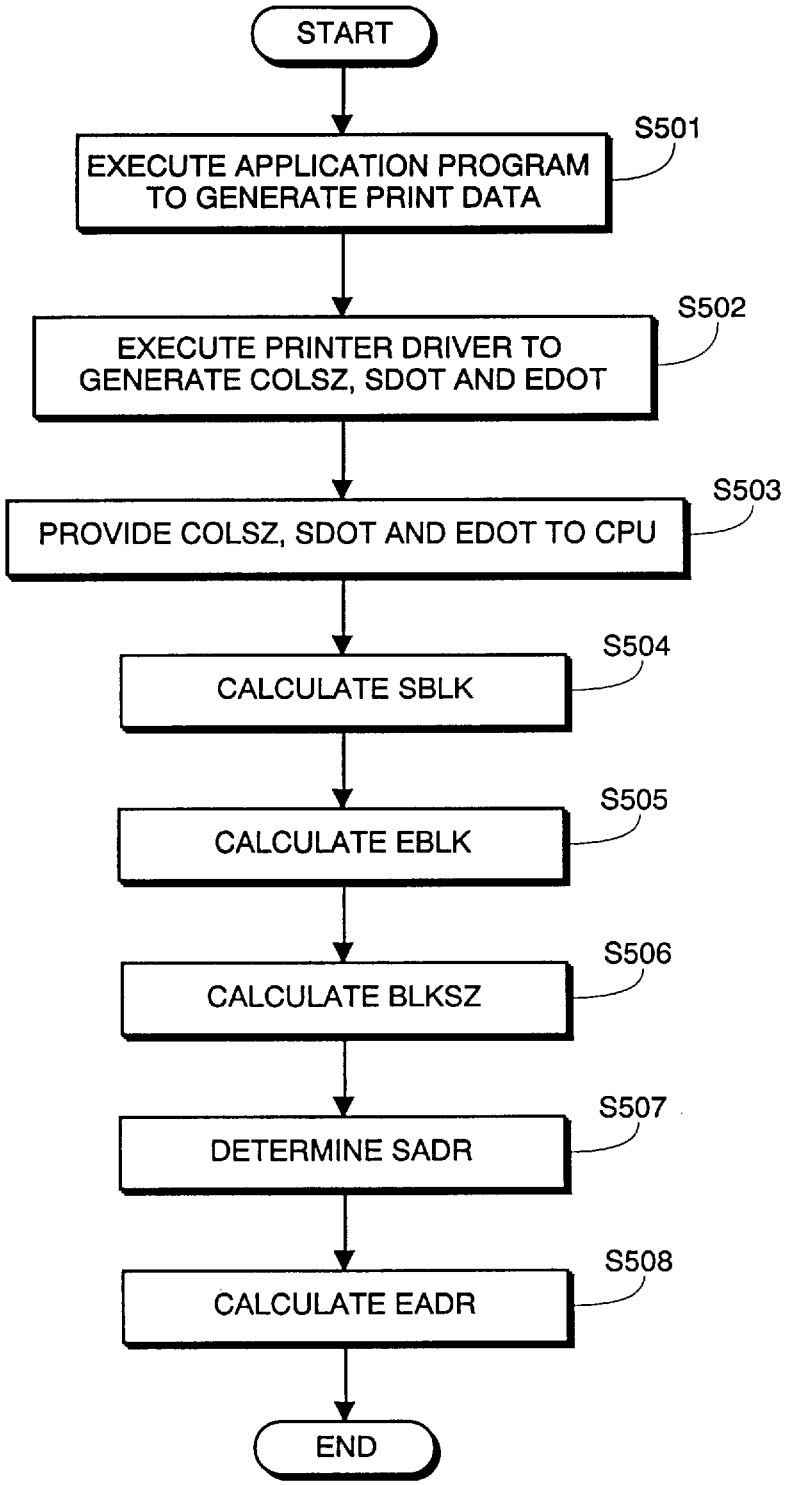
FIG. 5 is a flow diagram which shows process steps for allocating a print buffer according to the present invention.

FIG. 5 shows process steps of buffer allocation application program 24 for creating print buffer 32. As noted, these process steps typically are stored in ROM 14 and are executed by CPU 12 out of RAM 15.

In step S501, CPU 12 executes an application program, such as spreadsheet application program 27. At this point it is noted that while the following describes the present invention with respect to spreadsheet application program 27, the present invention can be used with any application program that can be run on word processor 1.

Returning to step S501, during execution, spreadsheet application program 27 generates print data and issues an instruction to print the print data. More specifically, a user enters data, spreadsheet application program 27 processes the data into print data, and the user executes a print command to print the print data. Thereafter, spreadsheet application program 27 instructs CPU 12 to print the print data.

Once spreadsheet application program 27 instructs CPU 12 to print the print data, in step S502, CPU 12 executes printer driver program 22. Printer driver program 22 receives the print data from spreadsheet application program 27 and formats the print data for output via printer 5. In formatting the print data, printer driver program 22 determines a number of columns of print data (hereinafter "COLSZ") generated by spreadsheet application program 27, a starting dot position (hereinafter "SDOT") on printer head 7, and an ending dot position (hereinafter "EDOT") on printer head 7. This process is described in more detail below.

As noted above, COLSZ defines a number of columns of print data generated by spreadsheet application program 27. A column of print data corresponds to an amount of print data which can be printed by printer head 7. For example, if printer head 7 has one row of 128 ink jets, and each ink jet is controlled by one bit of print data, one column of print data comprises 128 bits, i.e., one bit for each ink jet.

Typically, printer driver program 22 determines COLSZ based on a resolution of printer 5, and based on the physical size of the print data generated by spreadsheet application program 27. More specifically, printer driver program 22 determines COLSZ by multiplying the physical size (in inches) of the print data generated by spreadsheet application program 27 by the resolution in dots per inch of printer 5. Thus, if the print data produces an image which is 3 inches in length, and the resolution of printer 5 is 360 dots per inch, the number of columns of print data would be 360 multiplied by 3, or 1080.

SDOT defines a first operable ink jet in the row of ink jets on printer head 7. For example, if SDOT has a value of 0, this indicates that the first ink jet, i.e., ink jet 34, shown in FIG. 3, is operable of the ink jets on printer head 7. On the other hand, if SDOT has a value of 10, this indicates that an eleventh ink jet of the ink jets on printer head 7 is the first operable ink jet. Thus, in the latter case, the first through tenth ink jets on printer head 7 are inoperable.

Similarly, EDOT defines a last operable ink jet of the ink jets on printer head 7. As was the case with respect to SDOT, if EDOT is 54, for example, all ink jets after the fifty-fifth ink jet are inoperable.

Printer driver program 22 determines SDOT and EDOT based on the print data provided by spreadsheet application program 27. For example, if the print data comprises lines of characters which can be printed without using the top and bottom ink jets on printer head 7, SDOT and EDOT will reflect this.

In step S503, printer driver program 22 provides CPU 12 with values for COLSZ, SDOT and EDOT. Thereafter, CPU 12 executes buffer allocation application program 24, which uses these COLSZ, SDOT and EDOT parameters to determine the size of print buffer 32 for spreadsheet application program 27. More specifically, in step S504, buffer allocation application program 24 calculates a starting block of print data (hereinafter "SBLK") for each column of print data using SDOT.

In this regard, in the present invention, each column of print data is comprised of a plurality of useful blocks of print data. A block of print data corresponds to addresses in memory at which are stored predetermined amounts of print data. For example, as shown in FIG. 1, blocks AA, AB, etc., each store a predetermined number of bits of print data.

In a preferred embodiment of the present invention, 8 bits of print data are stored in each block print data. As noted above, each bit of print data controls one ink jet for printing one dot. It should be noted that the number of bits per block of print data can vary depending upon the type of hardware being used. For example, the present invention can be modified to operate with a print buffer that holds, for example, 16 or 32 bits of print data in a block of print data.

Thus, in step S504, buffer allocation application program 24 determines SBLK for the columns of print data by dividing SDOT by the predetermined amount of print data in each block print data, in this case 8 bits, and by taking the integer portion of the resulting dividend. For example, if SDOT is 1, SBLK is the integer portion of ⅛, or 0. Thus, for SDOT values of 0 to 7, SBLK is 0, which indicates the first block of print data. If, for example, SDOT is 8 to 15, SBLK is the integer portion of 8/8 to 15/8, respectively, or 1, and so on.

In a similar manner, in step S505, the ending block of print data (hereinafter "EBLK") for the columns of print data is determined using EDOT. For example, if EDOT is 127, EBLK is the integer portion of 127/8, or 15.

Next, in step S506, the amount of print data per each column of print data, i.e., the number of useful blocks of print data per column of print data, (hereinafter "BLKSZ") is determined. This value is determined as follows:

BLKSZ=EBLK−SBLK+1. That is, the number of blocks of print data per column of print data is equal to the ending block of print data minus the starting block of print data plus an address offset value. The address offset value accounts for a "0" memory address location, and is therefore assigned a value of 1. Thus, in the case that EBLK is 15 and SBLK is 0, i.e., in the case that all of the ink jets on printer head 7 are operable, BLKSZ is 16. In a case where BLKSZ is 16, there are 128 (=16*8) bits of print data per each column of print data.

Thus, as shown above, BLKSZ, which is calculated from SBLK and EBLK, is ultimately derived from the number of operable jets on printer head 7, as defined by SDOT and EDOT. In preferred embodiments of the present invention, SBLK, EBLK and BLKSZ are stored in RAM 15, in an area other than print buffer 32.

COLSZ, BLKSZ, SBLK and EBLK comprise size data for the print data which, in addition to being used in the designation of print buffer 32, are used by printer controller 21 to read out print data from print buffer 32. This process is described in more detail below.

Once BLKSZ is determined in step S506, processing proceeds to steps S507 and S508, in which address data, which defines the starting address and the ending address of print buffer 32, is determined. More specifically, in step S507 the starting address (hereinafter "SADR") of print buffer 32 in RAM 15 is set. SADR may be set by CPU 12 as any address in RAM 15. Preferably, SADR is set in an area of RAM 15 which is large enough to accommodate a print buffer, and which is currently unused.

Next, in step S508, buffer allocation application program 24 calculates the ending address of print buffer 32 (hereinafter "EADR"). Specifically, EADR is calculated as follows:

EADR=(COLSZ*BLKSZ)=1+SADR. COLSZ and BLKSZ determine the size of EADR, with an address offset value, in this case 1, subtracted therefrom to account for a "0" address location. SADR is included in the above calculation so as to place EADR at an address with respect to SADR in RAM 15.

Thus, by virtue of the process steps shown in FIG. 5, print buffer 32 is designated in RAM 5. That is, print buffer 32 starts at SADR and ends at EADR in RAM 15.

Figure 6:
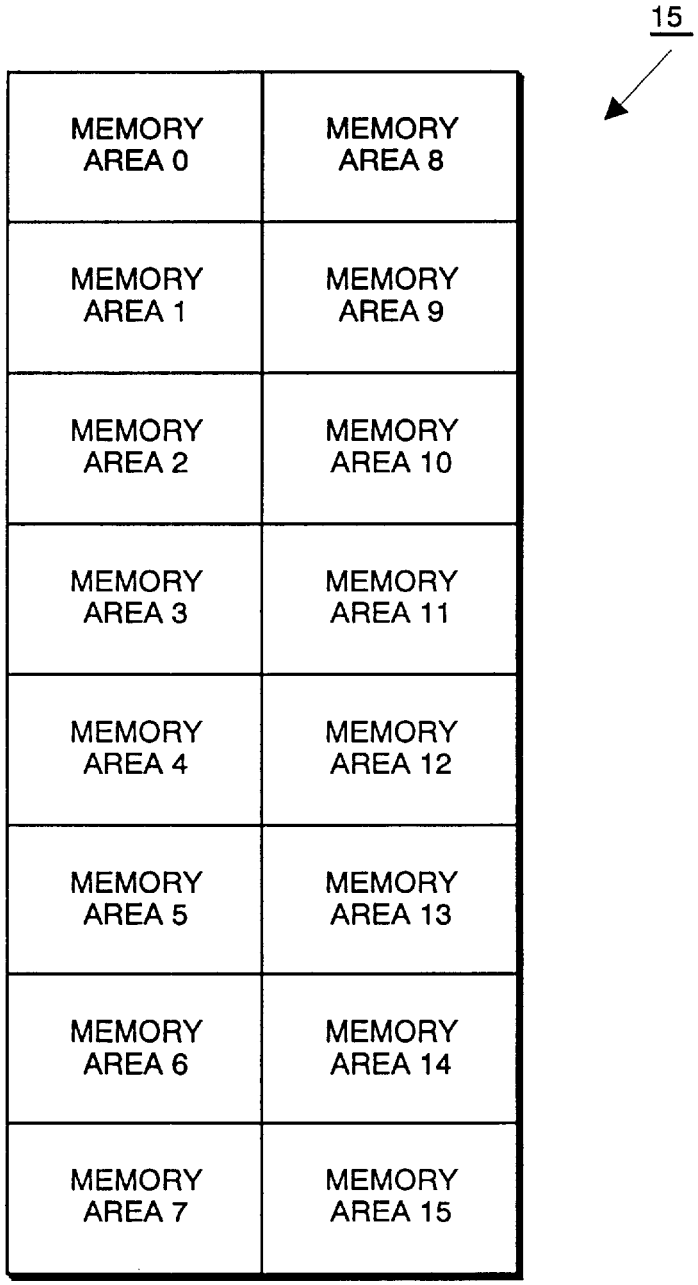
FIG. 6 shows a memory apportioned into 16 areas, any of which may be used to store a print buffer allocated via the present invention.

FIG. 6 shows RAM 15 broken down into sixteen contiguous memory areas, labelled 0 to 15. According to the present invention, print buffer 32 could be assigned to any one or more of these memory areas. It is, however, noted that FIG. 6 merely shows one way in which RAM 15 can be apportioned, and that RAM 15 can be broken down into any number of memory areas, to which print buffer 32 can be assigned.

Once print buffer 32 is designated in RAM 15, print data from spreadsheet application program 27 is stored in print buffer 32 by printer driver program 22. The remainder of RAM 15 can then be used for other storage. For example, as indicated above, CPU 12 can execute other applications out of areas of RAM 15 other than print buffer 32.

Next, outputting the print data from print buffer 32 using printer controller 21 will be described.

Initially, CPU 12 recognizes a printing instruction input via keyboard 4 during execution of spreadsheet application program 27. As described above, the printing instruction is received via keyboard controller 17. In response, CPU 12 instructs printer controller 21 to begin printing. At this point, it is noted that once CPU 12 instructs printer controller 21 to begin printing, printer controller 12 can print the print data in print buffer 32 without further assistance from CPU 12.

Figure 7:
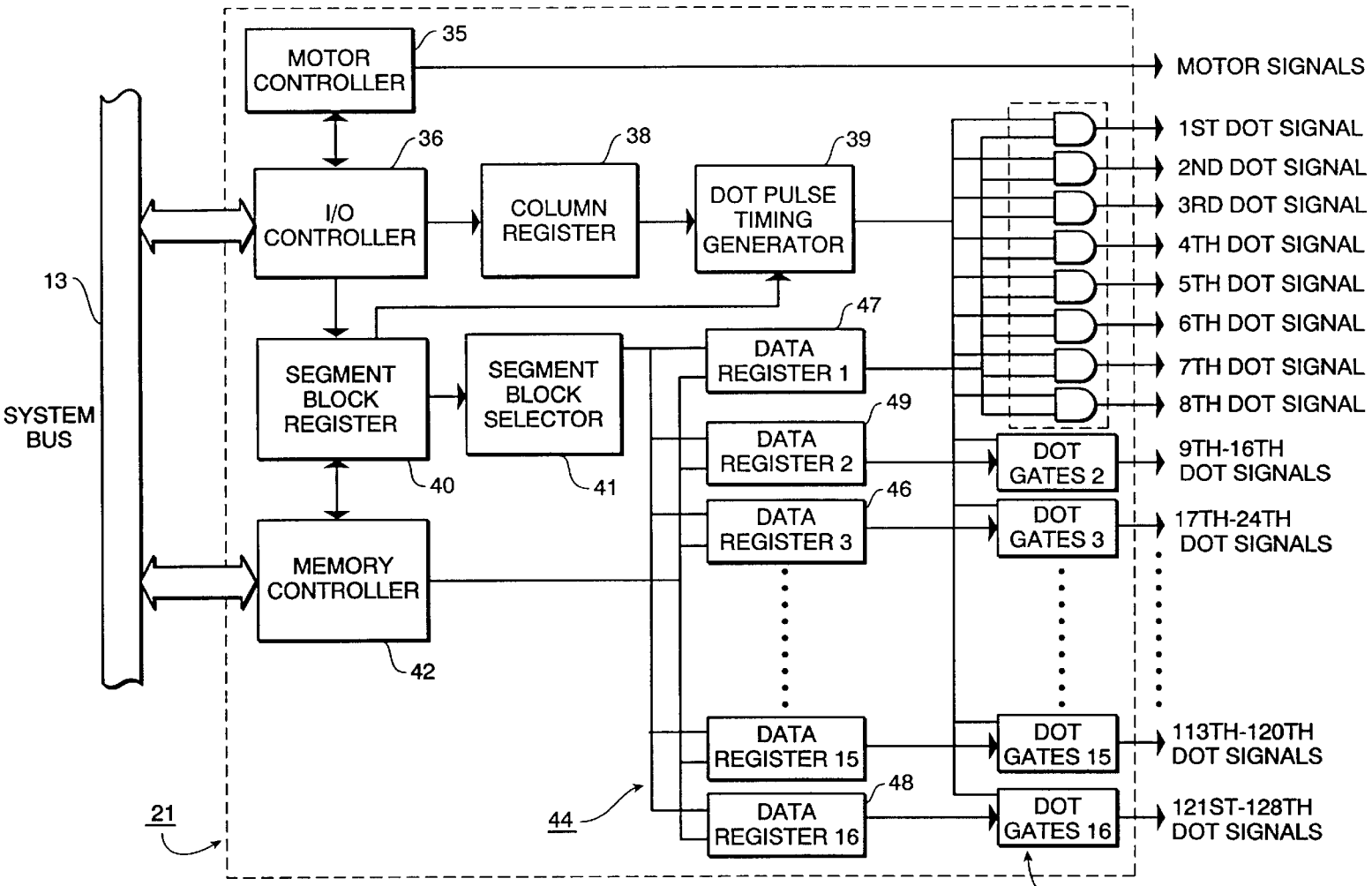
FIG. 7 shows a detailed diagram of the printer controller for the word processor depicted in FIG. 2.

FIG. 7 shows a detailed block diagram of printer controller 21. As shown in FIG. 7, printer controller 21 includes motor controller 35, input/output controller (hereinafter "I/O controller") 36, column register 38, dot pulse timing generator 39, segment block register 40, segment block selector 41, memory controller 42, a plurality of data registers 44, and a plurality of dot gates 45. Each of these elements will be described in greater detail below.

I/O controller 36 receives printing instructions from CPU 12 via system bus 13. I/O controller 36 interprets these printing instructions, which include the size data, i.e., COLSZ, BLKSZ, SBLK and EBLK, and the address data, i.e., SADR and EADR, and based on these printing instructions, initializes printer controller 21 for printing. It is noted that I/O controller 36 can comprise a microprocessor or a plurality of logic gates.

I/O controller 36 initializes printer controller 21 for printing by storing BLKSZ, SBLK and EBLK in segment block register 40, by storing COLSZ in column register 38, and by providing SADR and EADR to memory controller 42.

Segment block register 40 is a data register which stores values for BLKSZ, SBLK and EBLK, and which provides these values to segment block selector 41 and to memory controller 42, as required.

More specifically, segment block register 40 provides SBLK and EBLK to segment block selector 41 in response to a signal from memory controller 42, as described below. Segment block selector 41 uses these values to enable particular ones of data registers 44, into which print data from print buffer 32 is stored. For example, if SBLK has a value of 0 and EBLK has a value of 15, segment block selector 41 enables all sixteen of data registers 44. If, however, SBLK has a value of 4 and EBLK has a value of 6, for example, then segment block selector 41 enables only the fifth through the seventh of data registers 44. Thereafter, memory controller 42 reads print data from print buffer 32 into appropriate ones of data registers 44 which are enabled, as described in more detail below.

Each of data registers 44 latches one block, i.e., 8 bits, of print data read by memory controller 42. More specifically, memory controller 42 reads out blocks of print data from print buffer 32 beginning at SADR. Concurrently, memory controller 42 provides segment block register 40 with a signal, in response to which segment block register 40 provides segment block selector 41 with SBLK and EBLK. Memory controller 42 then latches the read out blocks of print data into appropriate ones of data registers 44 which have been enable by segment block selector 41. For example, if memory controller 42 is reading out a first block of print data, memory controller 42 stores that first block of print data in the first enabled data register. Thereafter, memory controller 42 stores the next block of print data in the next enabled data register, and so on, up until one block of print data has been stored in each of the enabled data registers, i.e., up until one column of print data has been stored in the enabled data registers.

In a preferred embodiment of the present invention, each of data registers 44 comprises several flip-flops interconnected so as to latch 8 bits of data. However, it is noted that the construction of the data registers can be varied depending upon the number of bits of data in a block of data and depending upon available hardware.

When memory controller 42 determines that an entire column of print data has been read from print buffer 32, it instructs segment block register 40 to provide a first signal to dot pulse timing generator 39. More specifically, memory controller 42 determines that an entire column of print data has been read by comparing BLKSZ, which is provided by segment block register 40, to the number of blocks of print data that have been read. Once memory controller 42 determines that an entire column of print data has been read, memory controller 40 instructs segment block register 40 to provide the first signal to dot pulse timing generator 39. This first signal is combined with a second signal from column register 38, and is used to control dot gates 45, as described in more detail below.

In this regard, as noted above, I/O controller 36 provides column register 38 with COLSZ, i.e., the total number of columns of print data stored in print buffer 32. When columns of print data remain to be printed, column register 38 outputs the second signal to dot pulse timing generator 39. It is noted that each time a column of print data has been printed, memory controller 42 notifies I/O controller 36, which decrements the value of COLSZ by one to indicate that a column of data has been printed. This new value is then provided to column register 38.

When the second signal from column register 38 is combined with the first signal from segment block register 40, dot pulse timing generator 39 outputs a print signal to dot gates 45. This print signal is used to print the print data latched in data registers 44. More specifically, the print signal from dot pulse timing generator 39 is combined with the output of each of data registers 44 in each of dot gates 45, and based on the combination, print data is either output or not output to the ink jets on printer head 7.

In this regard, as noted above, each of dot gates 45 controls one ink jet on printer head 7. In a preferred embodiment of the present invention, each dot gate comprises an "AND" gate. Thus, the print signal from dot pulse timing generator 39 is combined with the print data latched in data registers 44 using a logical "AND" operation.

In a preferred embodiment of the present invention, a logic "1" at the output of a dot gate indicates that an ink jet is to print a dot, whereas a logic "0" at the output of a dot gate indicates that an ink jet is not to print a dot. It is noted, however, that this can be varied as desired.

Motion of printer head 7 along guide 9 is controlled by motor controller 35. More specifically, once I/O controller 36 receives a printing instruction from CPU 12, I/O controller 36 instructs motor controller 35 that a print operation is to be performed. Thereafter, motor controller 35 instructs printer head 7 to move along guide 9 so that each column of print data is output to printer head 7 at an appropriate time. To this end, motor controller 35 controls the motion of print head 7 so that a column of print data is printed prior to another column of print data being output to printer head 7. Such control is achieved by accelerating printer head to a predetermined velocity and maintaining that velocity during printing.

In a preferred embodiment of the present invention, motor controller 35 accelerates printer head 7 to the predetermined velocity prior to printing the first column of print data. In addition, when printer head 7 reaches an end of a page, CPU 12 instructs printer 5 to advance a current page by one line. Thereafter, motor controller 35 stops printer head 7 and returns printer head 7 to a start printing position.

It should be noted that while the foregoing describes printing print data in only one direction, the present invention can be modified to print data in a reverse direction, in addition to the forward direction. This can be done, for example, by modifying memory controller 42 to read out the print data starting with EBLK and ending with SBLK for every other line of print data to be printed on a page.

Figures 8, 8A, 8B:
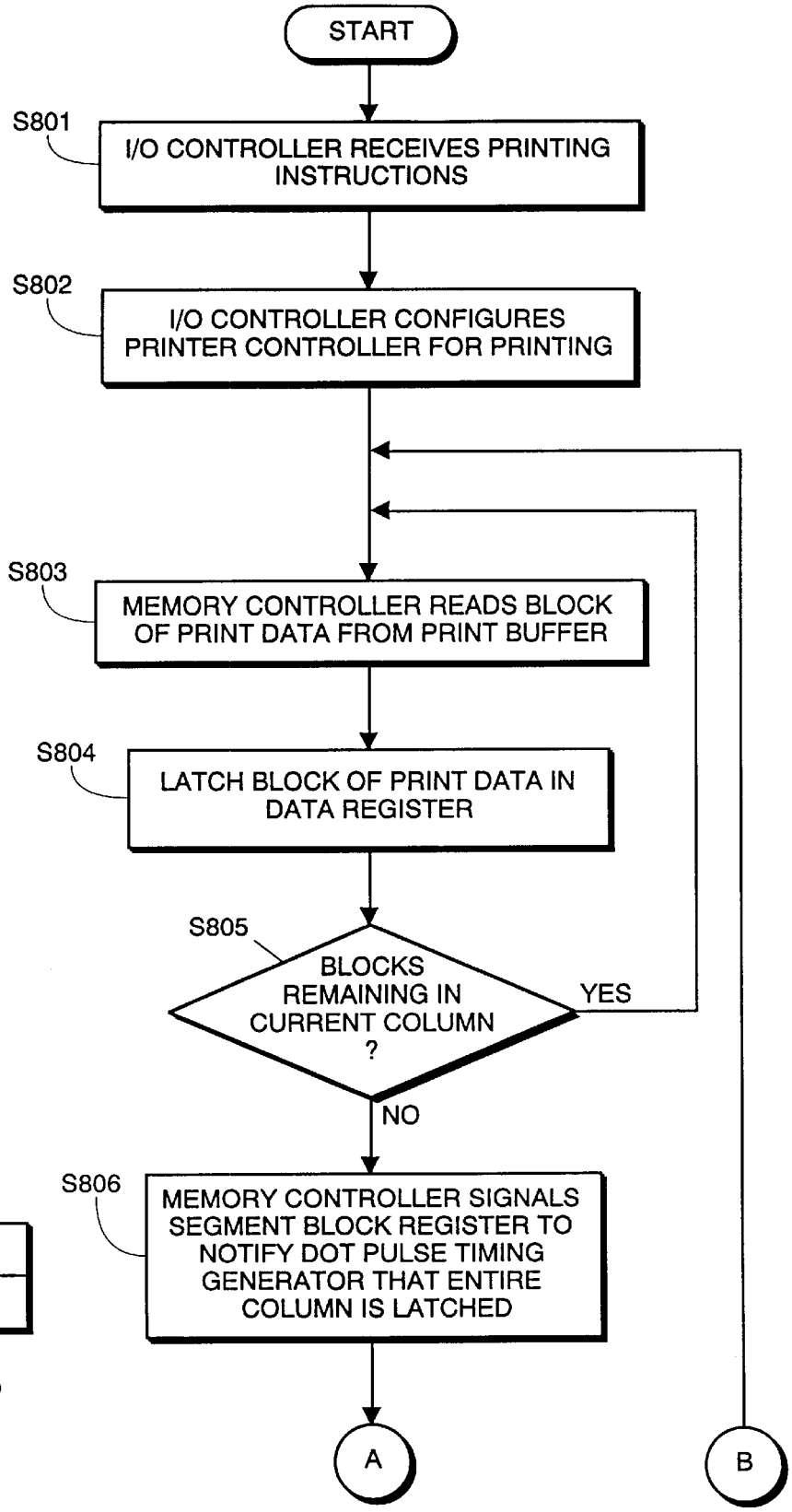
FIG. 8, comprised of FIGS. 8A and 8B, is a flow diagram which shows process steps for outputting print data from a print buffer via the printer controller shown in FIG. 7.
Figure 8B:
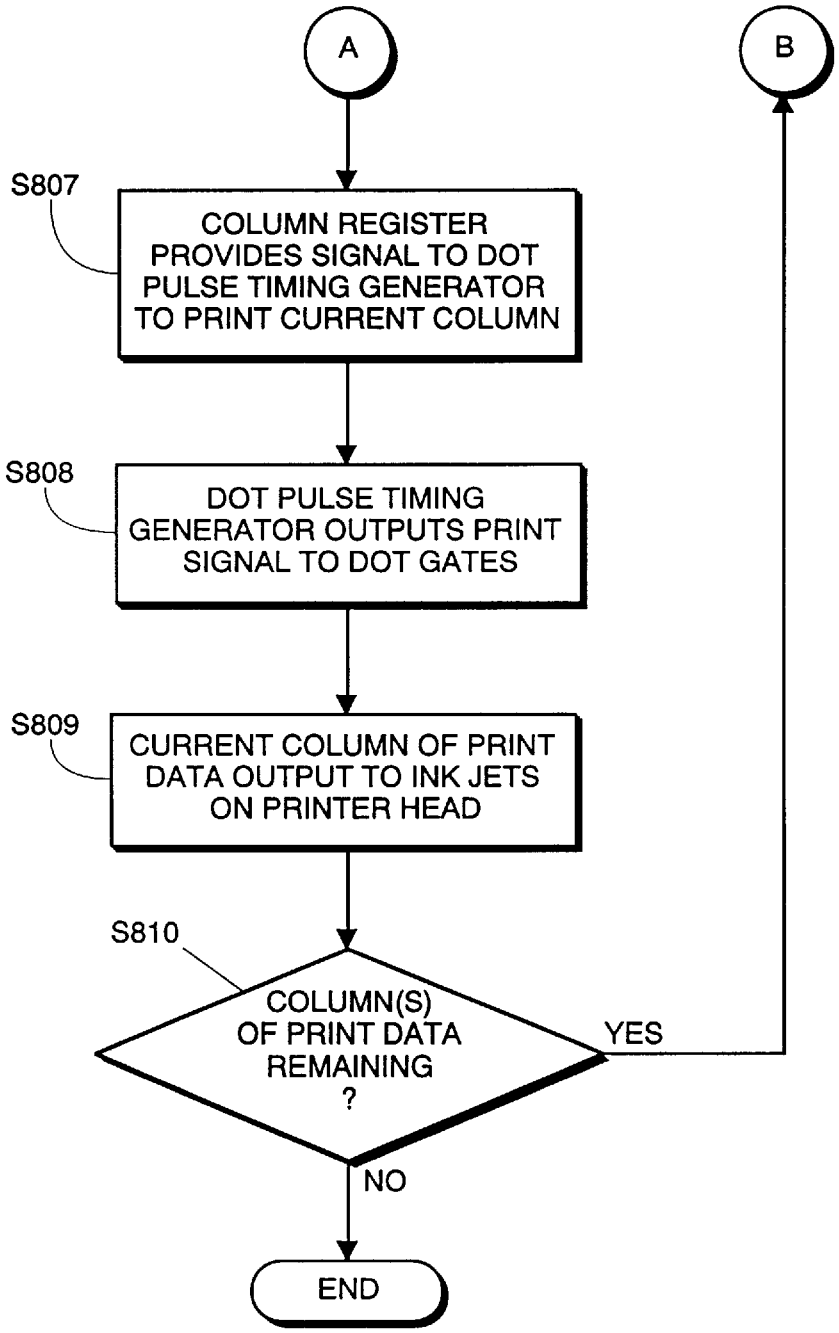

A printing operation using printer controller 21 will now be described with respect to FIG. 8.

In step S801, I/O controller 36 receives printing instructions from CPU 12. Upon receiving the printing instructions from CPU 12, in step S802 I/O controller 36 configures printer controller 21 for printing. That is, as described above, I/O controller 36 stores SBLK, EBLK and BLKSZ in segment block register 40, stores COLSZ in column register 38, and provides SADR and EADR to memory controller 42. Upon instruction from memory controller 42, segment block selector 41 enables ones of data registers 44 which correspond to values from SBLK to EBLK.

Next, in step S803, memory controller 42 reads out a block of print data from print buffer 32, beginning at SADR. Thereafter, in step S804, memory controller 42 latches the first block of print data that it reads from print buffer 32 in the first data register enabled by segment block selector 41. Next in step S805, memory controller 42 compares the current number of blocks of print data read to BLKSZ, provided by segment block register 40, to determine whether blocks of print data remain to be read, i.e., whether an entire column of print data has been latched in data registers 44. If blocks of print data remain to be read, i.e., an entire column of print data has not been latched, processing returns to step S803, whereafter subsequent blocks of print data, up to EBLK, are latched in respective ones of data registers 44.

Once an entire column of print data has been latched in data registers 44, in step S806, memory controller 42 signals segment block register 40 to output the first signal to dot pulse timing generator 39 which indicates that an entire column of print data has been latched in data registers 44. Next, in step S807, column register 38 provides the second signal to dot pulse timing generator 39, which indicates that the current column of print data can be output, as described above.

In step S808, dot pulse timing generator 39 combines the second signal from column register 38 and the first signal from segment block register 40 to output a print signal to dot gates 45. In step S809, this print signal is combined with print data latched in particular ones of data registers 44 to output control signals to the ink jets on printer head 7. As noted above, preferably, the print signal from dot pulse timing generator 39 is combined in dot gates 45 with the data from data registers 44 using "AND" gates, such that a logical "1" output by a dot gate indicates that a dot is to be formed by an ink jet which corresponds to that dot gate, and such that a logical "0" output by a dot gate indicates that a dot is not to be formed by an ink jet which corresponds to that dot gate.

Finally, in step S810, memory controller 42 determines whether additional columns of print data are to be printed from print buffer 32. Memory controller 42 does this by determining whether it has reached EADR. If memory controller 42 has not reached EADR, i.e., there are additional columns of print data to be printed, processing returns to step S803. If, however, no additional columns of print data remain in print buffer 32, processing ends.

It is noted that during the foregoing processing, motor controller 35 controls printer head 7 to move along guide 9 at an appropriate speed for printing.

FIG. 9 shows how dots on a page printed by printer head 7 correspond to print data in print buffer 32 in a case where printer head 7 is comprised of 128 ink jets, such as that shown in FIG. 2, and in a case where a print buffer such as that shown in FIG. 1 stores the print data.

It should be noted that while word processor 1 is described with respect to printer head 7, which includes one vertical row of ink jets which print data at a 90° angle to the direction of motion of printer head 7 along guide 9, the present invention can also be used with a printer head having differently-configured ink jets or other types of print elements, as the case may be. For example, the present invention can be used with a printer head that has ink jets aligned in a row which is parallel to the direction of motion of printer head 7 along guide 9. Likewise, the present invention can be used with a printer head that has ink jets arranged at any other angle with respect to the direction of motion of printer head 7 along guide 9.

The present invention has been described with respect to a particular illustrative embodiment. It is to be understood that the invention is not limited to the above-described embodiment and modifications thereto, and that various changes and modifications may be made by those of ordinary skill in the art without departing from the spirit and scope of the appended claims.

What is claimed is:

1. A dot matrix printing apparatus which designates an area of a memory as a print buffer and which outputs print data from the print buffer to a printer head having print elements for printing the print data, said dot matrix printing apparatus comprising:

a memory, an area of which is designatable as a print buffer;

a processor which (1) executes an application program to generate the print data, (2) determines size data for the print data, the size data comprising a number of columns of print data and a number of blocks of print data per each column, the number of blocks of print data per each column corresponding to a number of selected print elements on the printer head, where the number of selected print elements comprises a number of print elements on the printer head which are used during printing, (3) designates an area of said memory as a print buffer based on the size data, the print buffer being defined by address data, and (4) stores the print data in the print buffer such that the blocks of print data correspond to respective selected print elements on the printer head; and a controller which receives the size data and the address data from said processor, which uses the size data to correlate the blocks of print data to corresponding selected print elements, and which uses the address data to output columns of print data, one column at a time, from the print buffer to the selected print elements on the printer head, wherein said processor determines the size data for the print data by (1) executing a printer driver program to determine the number of columns of print data, and to determine first selected print element data and last selected print element data, and (2) executing a buffer allocation application program to determine the number of blocks of print data per each column of print data based on the first selected print element data and the last selected print element data and a predetermined number of bits of print data, wherein the size data further comprises a starting block of print data and an ending block of print data, wherein each block of print data comprises a predetermined number of bits of print data, wherein the starting block of print data comprises an integer portion of a dividend calculated by dividing the first selected print element data by the predetermined number of bits of print data, and the ending block of print data comprises an integer portion of a dividend calculated by dividing the last selected print element data by the predetermined number of bits of print data, and wherein the buffer allocation application program determines the number of blocks of print data per each column of print data by (1) determining a difference between the starting block of print data and the ending block of print data, and (2) adding an address offset value to the difference between the starting block of print data and the ending block of print data.

2. A dot matrix printing apparatus according to claim 1, wherein the address data comprises a starting address of the print buffer and an ending address of the print buffer; and wherein said processor designates the area of said memory as the print buffer by (1) assigning an address of said memory as the starting address, and (2) determining the ending address by (i) multiplying the number of columns of print data by the number of blocks of print data per each column of print data, (ii) subtracting an address offset value from a result of the multiplying, and (iii) adding the starting address to a result of the subtracting.

3. A dot matrix printing apparatus according to claim 2, wherein said controller comprises:

an input/output controller which receives the starting address, the ending address, the number of columns of print data, the starting block of print data, the ending block of print data and the number of blocks per column of print data, and which outputs the starting address, the ending address, the number of columns of print data, the starting block of print data, the ending block of print data and the number of blocks per column of print data;

a memory controller which receives, via the input/output controller, the number of blocks per column of print data, the starting address and the ending address, which reads print data from the print buffer, one column at a time, starting at the starting address and ending at the ending address, and which determines when a column of print data has been read by comparing a number of blocks which have been read to the number of blocks per column of print data;

a plurality of data registers which, when enabled, latch one column of print data read by the memory controller, each of the plurality of data registers latching one block of print data;

a dot pulse timing generator which outputs a print signal in response to reception of both a first signal which indicates that a column of print data has been read by the memory controller and a second signal which indicates that columns of print data remain to be printed;

a plurality of dot gates, each of which controls one print element on the printer head, which receive the one column of print data latched by the plurality of data registers and the print signal from the dot pulse timing generator, and which, in response, output the one column of print data to the print elements on the printer head;

a segment block register which receives the number of blocks per each column of print data, the starting block of print data and the ending block of print data from the input/output controller, which outputs the first signal to the dot pulse timing generator in a case where the memory controller determines that a column of print data has been read, and which outputs the starting block of print data and the ending block of print data when the memory controller begins to read the print data from the print buffer;

a segment block selector which receives the starting block of print data and the ending block of print data from the segment block register, and which enables particular ones of the plurality of data registers into which the one column of print data is to be latched based on the starting block of print data and the ending block of print data; and a column register which receives the number of columns of print data from the input/output controller, which determines whether columns of print data remain to be printed based on the number of columns of print data, and which outputs the second signal to the dot pulse timing generator after the memory controller reads out one column of print data from the print buffer in a case where columns of print data remain to be printed.

4. A method of controlling dot matrix printing in a dot matrix printer by designating an area of a RAM as a print buffer for storing print data comprised of M blocks by N columns, and by reading out the print data from the print buffer in order to print dot images, said method comprising the steps of:

executing an application program to generate the print data;

generating parameters which define a total number of columns of print data, a starting block of print data in each column of print data, and an ending block of print data in each column of print data;

determining a number of blocks of print data in each column of print data based on the starting block of print data in each column of print data and the ending block of print data in each column of print data;

allocating an area of a RAM as a print buffer based on the total number of columns of print data and the number of blocks of print data in each column of print data, the print buffer being defined by a starting address and an ending address;

storing the print data in the print buffer;

reading columns of print data from the print buffer, one at a time, beginning at the starting address of the print buffer and ending at the ending address of the print buffer using the total number of columns of print data and the number of blocks of print data in each column of print data;

outputting, the columns of print data, one at a time, to a printer head having a plurality of print elements for printing dot images; and printing the dot images, using the printer head, based on the columns of print data output in said outputting steps;

wherein the allocating step includes (1) setting a predetermined address as the starting address of the print buffer, and (2) determining the ending address of the print buffer by (i) determining a product of the total number of columns of print data and the number of blocks of print data in each column of print data, (ii) subtracting an offset value from the product of the total number of columns of print data and the number of blocks of print data in each column of print data, and (iii) adding the starting address of the print buffer to a value obtained by subtracting the offset value from the product of the total number of columns of print data and the number of blocks of print data in each column of print data.

5. A method according to claim 4, wherein each block of print data corresponds to a predetermined number of bits of print data;

wherein said generating step includes executing a printer driver program to determine the total number of columns of print data, a first operable print element on the printer head, and a last operable print element on the printer head;

wherein said determining step includes determining the starting block of print data in each column of print data based upon the first operable print element on the printer head and the predetermined number of bits of print data in each block of print data; and wherein said determining step further includes determining the ending block of print data in each column of print data based upon the last operable print element on the printer head and the predetermined number of bits of print data in each block of print data.

6. A method according to claim 4, wherein said determining step comprises determining a difference between a number of the starting block of print data and a number of the ending block of print data, and adding an offset value to the difference between the number of the starting block of print data and the number of the ending block of print data.

7. A method according to claim 4, wherein said reading step includes storing each block of print data read out from the print buffer in a corresponding one of a plurality of data registers such that each column of print data is latched in the plurality of data registers prior to being output in said outputting step.

8. A method according to claim 7, wherein said outputting step includes outputting a column of print data latched in the plurality of data registers based on the total number of columns of print data and an indication that a column of print data has been latched in the plurality of data registers.

9. A method according to claim 8, wherein said printing step includes accelerating the printer head to a predetermined velocity before an entire column of print data is latched in the plurality of data registers, and, after an entire column of print data is latched in the plurality of data register, printing the entire column of print data via the printer head.

* * * * *